US011443709B2

(12) United States Patent
Tung et al.

(10) Patent No.: US 11,443,709 B2
(45) Date of Patent: Sep. 13, 2022

(54) DISPLAY PANEL WITH REDUCED BORDER AREA IMPROVING CHARGING AND DISCHARGING CAPACITIES OF GATE DRIVING CIRCUIT

(71) Applicant: Au Optronics Corporation, Hsinchu (TW)

(72) Inventors: Che-Wei Tung, Hsinchu (TW); Wei-Li Lin, Hsinchu (TW); Chin-Hsien Chou, Hsinchu (TW); Yen-Wei Yeh, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 17/394,382

(22) Filed: Aug. 4, 2021

(65) Prior Publication Data

US 2022/0215809 A1 Jul. 7, 2022

(30) Foreign Application Priority Data

Jan. 6, 2021 (TW) ..... 110100426

(51) Int. Cl.
*G09G 3/36* (2006.01)

(52) U.S. Cl.
CPC ..... *G09G 3/3677* (2013.01); *G09G 3/3655* (2013.01); *G09G 3/3696* (2013.01); *G09G 2310/08* (2013.01); *G09G 2320/0223* (2013.01)

(58) Field of Classification Search
CPC ..... G09G 3/36; G09G 3/3611; G09G 3/3614; G09G 3/3622; G09G 3/3625; G09G 3/3655; G09G 3/3674; G09G 3/3677; G09G 3/3681; G09G 3/3696; G09G 2320/0223
USPC ..... 345/87–104
See application file for complete search history.

(56) References Cited

U.S. PATENT DOCUMENTS 5,784,039 A * 7/1998 Yasui ..... G09G 3/3648 345/89
7,355,575 B1 * 4/2008 Ota ..... G09G 3/3655 345/87
8,325,127 B2 12/2012 Chang et al.
9,035,923 B2 5/2015 Kimura et al.
9,552,761 B2 1/2017 Kimura et al.
(Continued)

FOREIGN PATENT DOCUMENTS

CN 102402933 4/2012
TW I571848 2/2017
(Continued)

*Primary Examiner* — Alexander Eisen
*Assistant Examiner* — Nelson Lam
(74) *Attorney, Agent, or Firm* — JCIPRNET

(57) ABSTRACT

A display panel is provided. The display panel includes a plurality of scan lines and a gate driving circuit. The scan lines are disposed on the display panel along a first direction, and respectively provide a plurality of gate driving signals. The gate driving circuit is disposed on a first side of the display panel along a second direction. The second direction intersects the first direction. The gate driving circuit includes a plurality of bias generators and a plurality of signal output circuits. The signal output circuits are divided into a plurality of groups. The bias generators respectively correspond to the groups. The bias generators generate a plurality of first bias voltages. The groups generate the gate driving signals respectively according to the first bias voltages.

11 Claims, 9 Drawing Sheets

110

(56) References Cited

U.S. PATENT DOCUMENTS

| | | | | |
|---|---|---|---|---|
| 9,990,894 | B2 | 6/2018 | Kimura et al. | |
| 10,140,942 | B2 | 11/2018 | Kimura et al. | |
| 10,304,402 | B2 | 5/2019 | Kimura et al. | |
| 10,510,310 | B2 | 12/2019 | Kimura et al. | |
| 10,957,267 | B2 | 3/2021 | Kimura et al. | |
| 2003/0234904 | A1* | 12/2003 | Matsuda | G02F 1/1345 349/152 |
| 2007/0164957 | A1* | 7/2007 | Hsieh | G09G 3/3655 345/90 |
| 2012/0062528 | A1 | 3/2012 | Kimura et al. | |
| 2015/0029170 | A1* | 1/2015 | Shin | G09G 3/3648 345/212 |
| 2015/0339971 | A1 | 11/2015 | Kimura et al. | |
| 2015/0371599 | A1* | 12/2015 | Xiao | G09G 3/20 345/212 |
| 2016/0180817 | A1* | 6/2016 | Cho | G09G 3/20 345/213 |
| 2017/0116942 | A1 | 4/2017 | Kimura et al. | |
| 2018/0286337 | A1 | 10/2018 | Kimura et al. | |
| 2019/0108806 | A1 | 4/2019 | Kimura et al. | |
| 2019/0279586 | A1 | 9/2019 | Kimura et al. | |
| 2020/0118507 | A1 | 4/2020 | Kimura et al. | |
| 2021/0210039 | A1 | 7/2021 | Kimura et al. | |
| 2021/0225240 | A1 | 7/2021 | Tung et al. | |

FOREIGN PATENT DOCUMENTS

| | | |
|---|---|---|
| TW | I616865 | 3/2018 |
| TW | I717983 | 2/2021 |

* cited by examiner

DISPLAY PANEL WITH REDUCED BORDER AREA IMPROVING CHARGING AND DISCHARGING CAPACITIES OF GATE DRIVING CIRCUIT

CROSS-REFERENCE TO RELATED APPLICATION

This application claims the priority benefit of Taiwan application serial no. 110100426, filed on Jan. 6, 2021. The entirety of the above-mentioned patent application is hereby incorporated by reference herein and made a part of this specification.

BACKGROUND

Technical Field

The disclosure relates to a display panel, and particularly relates to a display panel with a zero border display (ZBD) design.

Description of Related Art

The ZBD design refers to a design that in order to reduce the border size of a display panel, the gate driving circuit (gate driver-on-array, GOA) conventionally arranged on both sides of the display panel is moved to the sky side of the display panel, and then multiple gate signal lines are used to output gate driving signals to each column of scan lines to drive the corresponding pixels for display. With such a design, the border of the display panel can be less than 1 mm.

However, after the gate driving circuit is moved to the sky side of the display panel, the border area on the sky side increases significantly, and a large number of gate signal lines need to be additionally disposed, which increases the resistive and capacitive loads and the mutual capacitance on the output terminal of the gate driving circuit, and causes the charging and discharging capabilities of the gate driving circuit to drop greatly.

SUMMARY

The disclosure provides a display panel that has a reduced border area and improves the charging and discharging capabilities of a gate driving circuit.

The display panel according to the disclosure includes a plurality of scan lines and a gate driving circuit. The scan lines are arranged on the display panel along a first direction, and respectively provide a plurality of gate driving signals. The gate driving circuit is arranged on a first side of the display panel along a second direction that intersects the first direction. The gate driving circuit includes a plurality of bias generators and a plurality of signal output circuits. The signal output circuits are divided into a plurality of groups. The bias generators respectively correspond to the groups. The bias generators generate a plurality of first bias voltages. The groups generate the gate driving signals respectively according to the first bias voltages.

Based on the above, in the display panel according to the disclosure, the gate driving circuit is arranged on the side of the display panel along another direction intersecting the direction in which the scan lines are arranged, and the gate driving signals are generated and provided to the scan lines through a plurality of bias generators and a plurality of corresponding signal output circuits. In this way, the border area of the display panel can be greatly reduced, and the charging and discharging capabilities of the gate driving circuit can also be improved.

In order to make the above-mentioned and other features and advantages of the disclosure more comprehensible, several exemplary embodiments are described in detail hereinafter with reference to the accompanying drawings.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EMBODIMENTS

The term "couple (or connect)" used throughout the specification (including the claims) may refer to any direct or indirect connection means. For example, when it is described in the specification that the first device is coupled (or connected) to the second device, it should be interpreted as that the first device may be directly connected to the second device, or the first device may be indirectly connected to the second device through another device or a certain connection means. The terms "first," "second," etc. in the specification (including the claims) are used to name the elements, or to distinguish different embodiments or ranges from each other, and are not used to limit the upper or lower limit of the number of elements nor the order of the elements.

Figure 1:
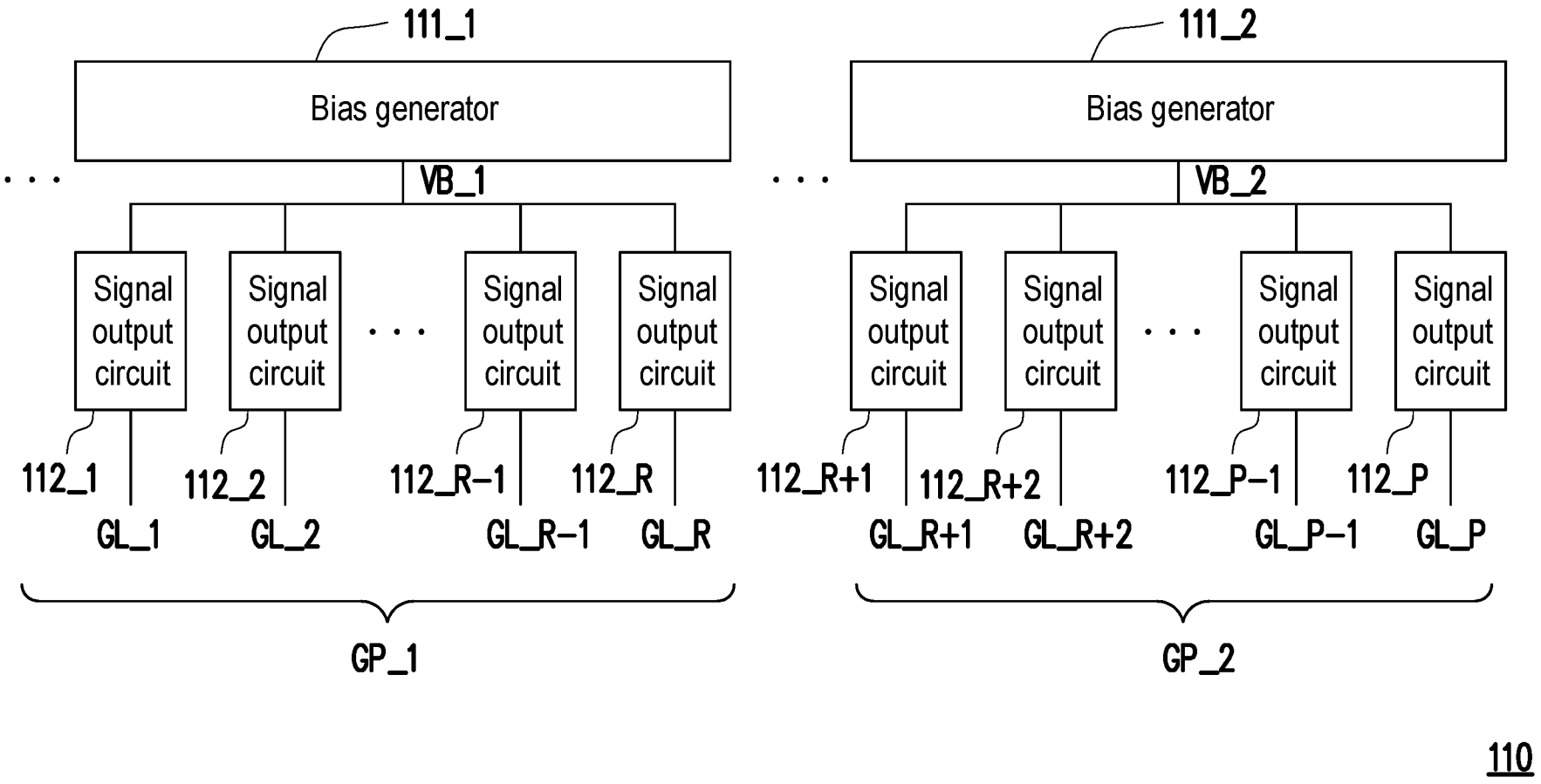
FIG. 1 is a schematic diagram of a gate driving circuit according to an embodiment of the disclosure.

Please refer to FIG. 1. FIG. 1 is a schematic diagram of a gate driving circuit according to an embodiment of the disclosure. The gate driving circuit 110 is adapted for a display panel. In FIG. 1, the gate driving circuit 110 is constructed by coupling a plurality of bias generators and a plurality of signal output circuits in series. For example, in this embodiment, the gate driving circuit 110 includes bias generators 111_1 and 111_2 and signal output circuits 112_1 to 112_P. The signal output circuits 112_1 to 112_R and 112_R+1 to 112_P (P>R) may respectively form groups GP_1 and GP_2. The bias generators 111_1 and 111_2 may respectively correspond to the groups GP_1 and GP_2, and respectively generate first bias voltages VB_1 and VB_2 for the corresponding groups GP1 and GP2. The signal output circuits 112_1 to 112_P may generate gate driving signals GL_1 to GL_P respectively according to the received first bias voltage VB_1 or VB_2.

In this embodiment, the bias generators 111_1 and 111_2 may be implemented using shift registers, and the signal output circuits 112_1 to 112_P may use a combination of a pull-up circuit and a pull-down circuit to adjust the first bias voltage VB_1 or VB_2 generated by the bias generator 111_1 or 111_2. According to design requirements, the signal output circuits 112_1 to 112_R in the group GP_1 may be the same, the signal output circuits 112_R+1 to 112_P in the group GP_2 may be the same, and the signal output circuits 112_1 to 112_P in different groups GP_1 and GP_2 may be different (for example, the signal output circuit 112_1 in the group GP_1 and the signal output circuit 112_R+1 in the group GP_2). Regarding the details of implementation of the bias generators 111_1 and 111_2 and the signal output circuits 112_1 to 112_P, please refer to the embodiments described later. In other embodiments, the gate driving circuit 110 may include other numbers of bias generators and signal output circuits, and the disclosure is not limited thereto.

It is worth mentioning that, in the display panel of the disclosure, the gate driving circuit is provided with a plurality of bias generators and a plurality of corresponding signal output circuits, and generates a plurality of gate driving signals to the scan lines. In this way, the border area of the display panel can be greatly reduced, and the charging and discharging capabilities of the gate driving circuit can also be improved.

Figure 2:
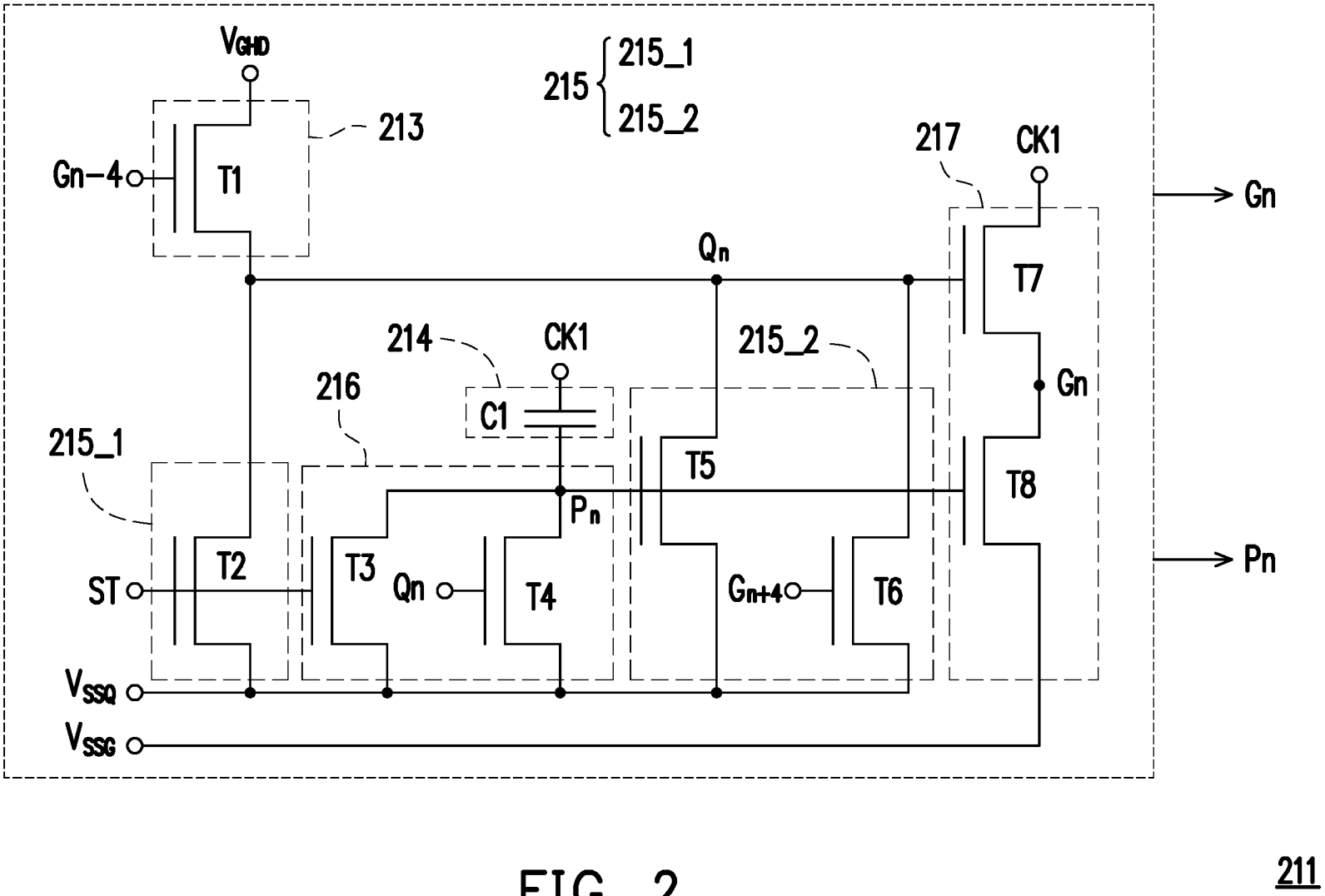
FIG. 2 is a schematic diagram of a bias generator according to an embodiment of the disclosure.

Please refer to FIG. 2 for the implementation of the bias generators 111_1 and 111_2 in the example of FIG. 1. FIG. 2 is a schematic diagram of a bias generator according to an embodiment of the disclosure. In FIG. 2, the bias generator 211 includes a first pull-up circuit 213, a second pull-up circuit 214, a first pull-down circuit 215, a second pull-down circuit 216, and an output stage circuit 217. The bias generator 211 is configured to generate a first bias voltage $G_n$. In an embodiment, the bias generator 211 may also provide a second control voltage $P_n$ as a second bias voltage. The bias generator 211 may output the first bias voltage $G_n$ and/or the second control voltage $P_n$ to a plurality of signal output circuits in the corresponding group.

In this embodiment, the first pull-up circuit 213 receives a first voltage $V_{GHD}$ and a fore-stage bias voltage (for example, a fore-four stage bias voltage $G_{n-4}$ in this embodiment, but the disclosure is not limited thereto), and is configured to pull up a first control voltage $Q_n$. The second pull-up circuit 214 receives a first clock signal CK1, and is configured to pull up a second control voltage $P_n$. The first pull-down circuit 215 receives a start signal ST, the second control voltage $P_n$, and/or a post-stage bias voltage (for example, a post-four stage bias voltages $G_{n+4}$ in this embodiment, but the disclosure is not limited thereto), and is configured to pull down the first control voltage $Q_n$. The second pull-down circuit 216 receives the start signal ST and/or the first control voltage $Q_n$, and is configured to pull down the second control voltage $P_n$. The output stage circuit 217 receives the first control voltage $Q_n$ and the second control voltage $P_n$, and is configured to generate the first bias voltage $G_n$.

In detail, the first pull-up circuit 213 is composed of a transistor T1. The first terminal of the transistor T1 receives the first voltage $V_{GHD}$, and the control terminal (gate) of the transistor T1 receives the fore-stage bias voltage $G_{n-4}$, so that the transistor T1 can pull up the first control voltage $Q_n$ on the second terminal of the transistor T1 according to the fore-stage bias voltage $G_{n-4}$ based on the first voltage $V_{GHD}$. The second pull-up circuit 214 is composed of a capacitor C1. The first terminal of the capacitor C1 receives the clock signal CK1, so that the capacitor C1 can pull up the second control voltage $P_n$ on the second terminal of a capacitor C2 according to the clock signal CK1.

The first pull-down circuit 215 includes transistors T2, T5, and T6. The first terminals of the transistors T2, T5, and T6 jointly receive the first control voltage $Q_n$, the second terminals of the transistors T2, T5, and T6 jointly receive a second voltage $V_{SSQ}$, and the control terminals (gates) of the transistors T2, T5, and T6 respectively receive the start signal ST, the second control voltage $P_n$, and the post-stage bias voltage $G_{n+4}$, so that the transistors T2, T5, and T6 can pull down the first control voltage $Q_n$ according to the start signal ST, the second control voltage $P_n$, and the post-stage bias voltage $G_{n+4}$.

The second pull-down circuit 216 includes transistors T3 and T4. The first terminals of the transistors T3 and T4 jointly receive the second control voltage $P_n$, the second terminals of the transistors T3 and T4 jointly receive the second voltage $V_{SSQ}$, and the control terminals (gates) of the transistors T3 and T4 respectively receive the start signal ST and the first control voltage $Q_n$, so that the transistors T3 and T4 can pull down the second control voltage $P_n$ according to the start signal ST and the first control voltage $Q_n$.

The output stage circuit 217 may be a buffer. For example, in this embodiment, the output stage circuit 217 includes transistors T7 and T8. The first terminal of the transistor T7 receives the first clock signal CK1, and the control terminal (gate) of the transistor T7 receives the first control voltage $Q_n$. The first terminal of the transistor T8 is coupled to the second terminal of the transistor T7, the second terminal of the transistor T8 receives a third voltage $V_{SSG}$, and the control terminal (gate) of the transistor T8 receives the second control voltage $P_n$, so that the transistors T7 and T8 can generate the first bias voltage $G_n$ on the second terminal of the transistor T7 according to the first control voltage $Q_n$ and the second control voltage $P_n$.

Figure 3A:
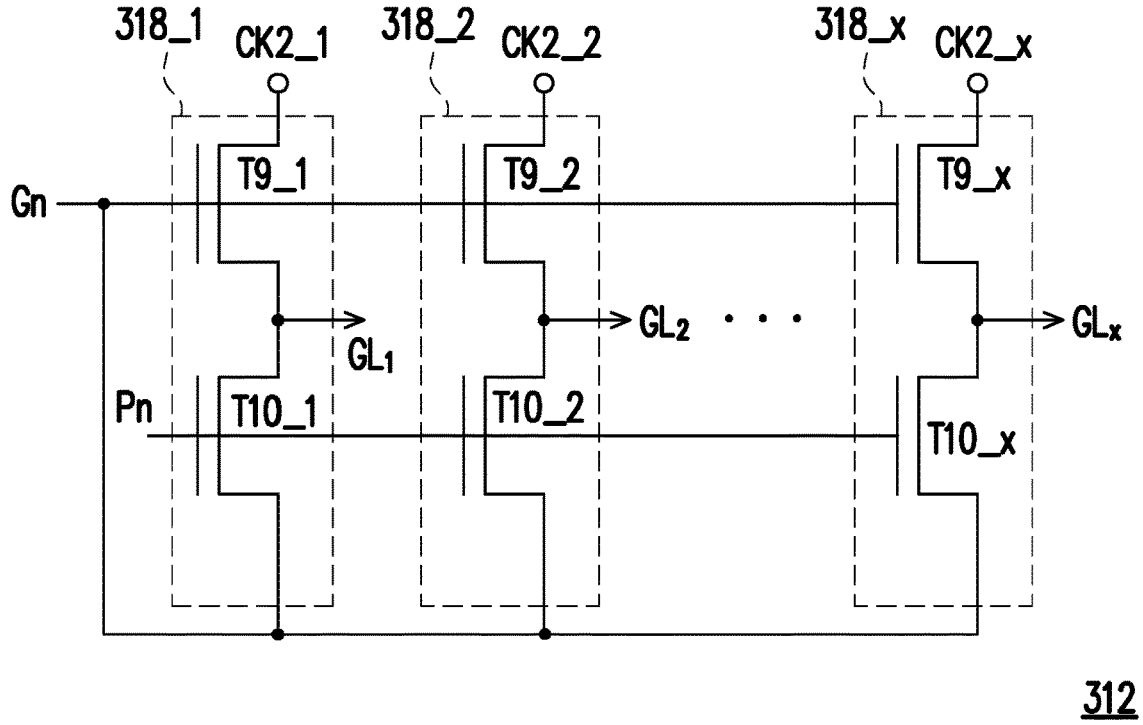
FIG. 3A to FIG. 3C are schematic diagrams of signal output circuits according to different embodiments of the disclosure.
Figure 3B:
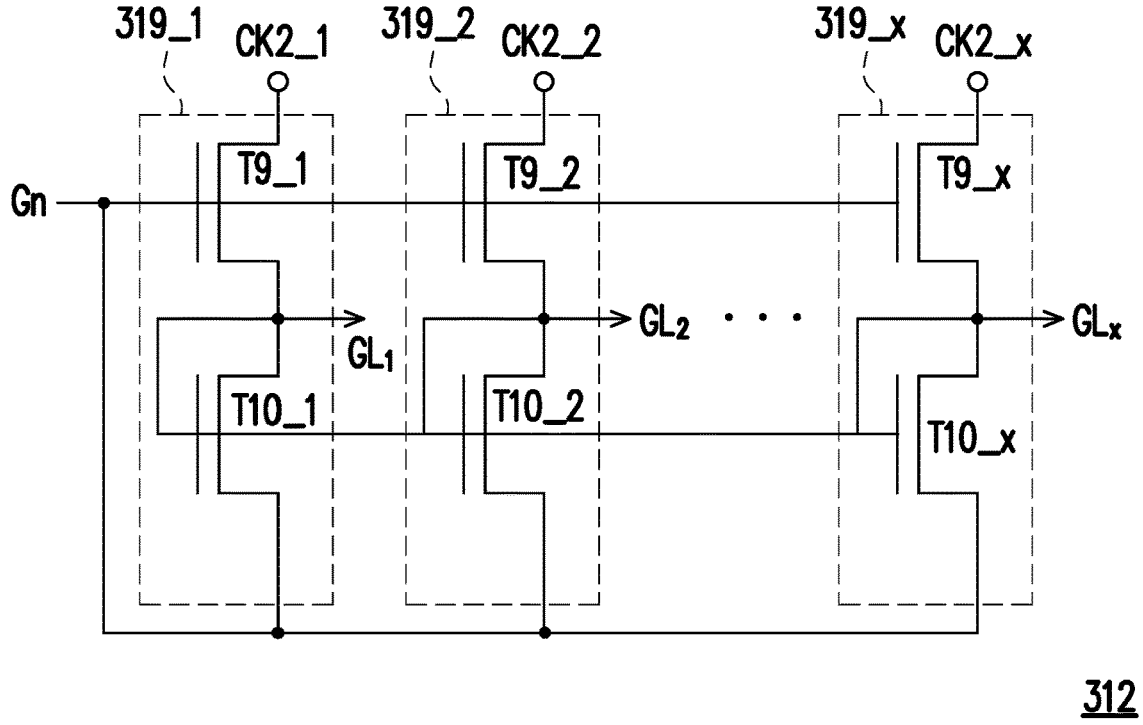
Figure 3C:
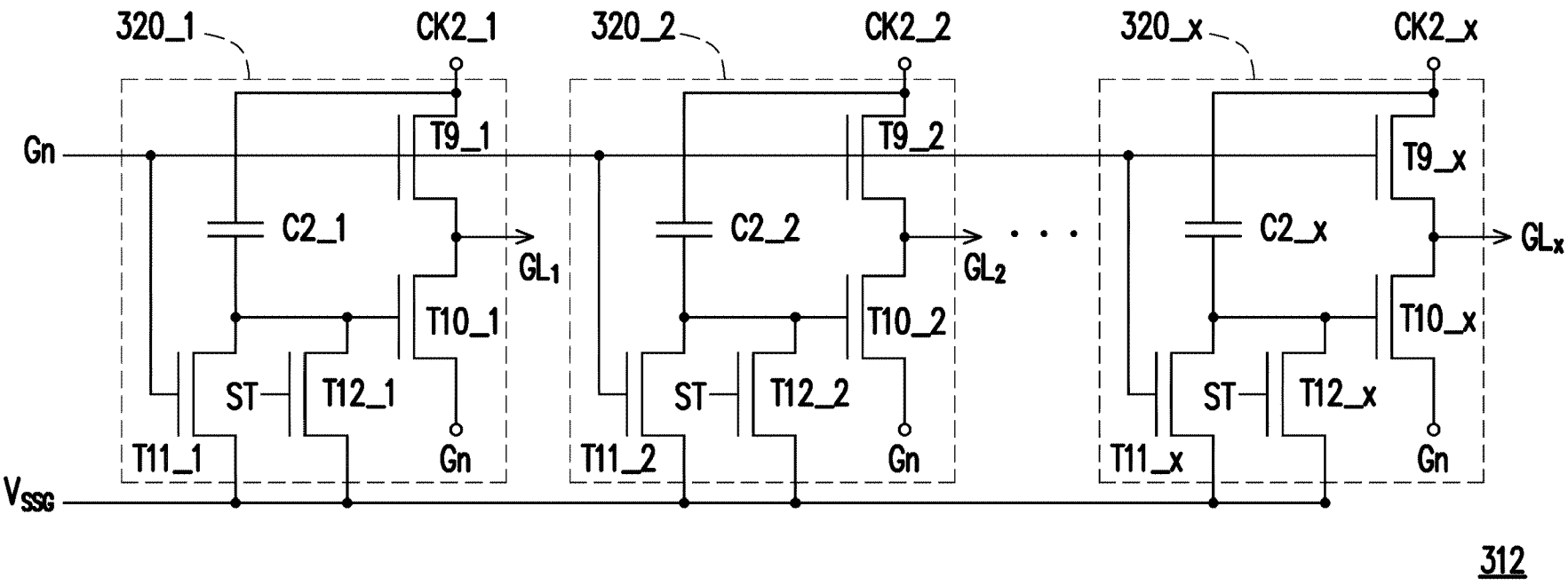

Please refer to FIG. 3A to FIG. 3C for the implementation of the signal output circuits 112_1 to 112_P in the example of FIG. 1. FIG. 3A to FIG. 3C are schematic diagrams of signal output circuits according to different embodiments of the disclosure. The signal output circuits 312 in FIG. 3A to FIG. 3C are all configured to receive a plurality of second clock signals CK2_1 to CK2_*x* to generate the corresponding gate driving signals $GL_1$ to $GL_x$ according to the first bias voltage $G_n$ and/or the second control voltage $P_n$ as the second bias voltage generated by the above-mentioned bias generator (for example, the bias generator 211 shown in FIG. 2).

In FIG. 3A, the signal output circuit 312 includes buffers 318_1 to 318_*x*. The buffers 318_1 to 318_*x* are respectively the combinations of transistors T9_1 to T9_*x* and T10_1 to T10_*x*. Take the buffer 318_1 as an example, the first terminal of the transistor T9_1 receives a second clock signal CK2_1. The first terminal of the transistor T10_1 is coupled to the second terminal of the transistor T9_1. The control terminal of the transistor T9_1 and the second terminal of the transistor T10_1 jointly receive the first bias voltage $G_n$. The control terminal of the transistor T10_1 receives the second control voltage $P_n$, so that the buffer 318_1 can generate the corresponding gate driving signal $GL_1$ on the second terminal of the transistor T9_1 according to the first bias voltage $G_n$ and the second control voltage $P_n$. The elements in the other buffers 318_2 to 318_*x* are coupled in the same manner, which is not repeated hereinafter.

In FIG. 3B, the signal output circuit 312 includes buffers 319_1 to 319_*x*. The buffers 319_1 to 319_*x* are respectively the combinations of transistors T9_1 to T9_x and T10_1 to T10_x. Take the buffer 319_1 as an example, the first terminal of the transistor T9_1 receives the second clock signal CK2_1. The transistor T10_1 may be coupled as a diode configuration, and the anode of the diode configured is coupled to the second terminal of the transistor T9_1, and the cathode of the diode configured and the control terminal of the transistor T9_1 jointly receive the first bias voltage $G_n$, so that the buffer 318_1 can generate the corresponding gate driving signal $GL_1$ on the second terminal of the transistor T9_1 only according to the first bias voltage $G_n$. The buffer 318_1 may also maintain the voltage value of the gate driving signal $GL_1$ according to the gate driving signal $GL_1$ and the first bias voltage $G_n$ through the transistor T10_1. The elements in the other buffers 319_2 to 319_x are coupled in the same manner, which is not repeated hereinafter.

In FIG. 3C, the signal output circuit 312 includes multi-stage voltage generators 320_1 to 320_x. The voltage generators 320_1 to 320_x respectively include transistors T9_1 to T9_x, T10_1 to T10_x, T11_1 to T11_x, T12_1 to T12_x, and capacitors C2_1 to C2_x. Take the voltage generator 320_1 as an example, the first terminal of the transistor T9_1 receives the second clock signal CK2_1. The first terminal of the transistor T10_1 is coupled to the second terminal of the transistor T9_1, and the control terminal of the transistor T9_1 and the second terminal of the transistor T10_1 jointly receive the first bias voltage $G_n$. The first terminals of the transistors T11_1 and T12_1 are jointly coupled to the control terminal of the transistor T10_1, and the second terminals of the transistors T11_1 and T12_1 jointly receive the second voltage $V_{SSG}$. The control terminals of the transistor T11_1 and the transistor T12_1 respectively receive the first bias voltage $G_n$ and the start signal ST. The capacitor C2_1 is coupled between the first terminal of the transistor T9_1 and the control terminal of the transistor T10_1, so that the voltage generator 320_1 can generate the corresponding gate driving signal $GL_1$ on the second terminal of the transistor T9_1 according to the first bias voltage $G_n$. The elements in the other voltage generators 320_2 to 320_x are coupled in the same manner, which is not repeated hereinafter.

Figure 4:
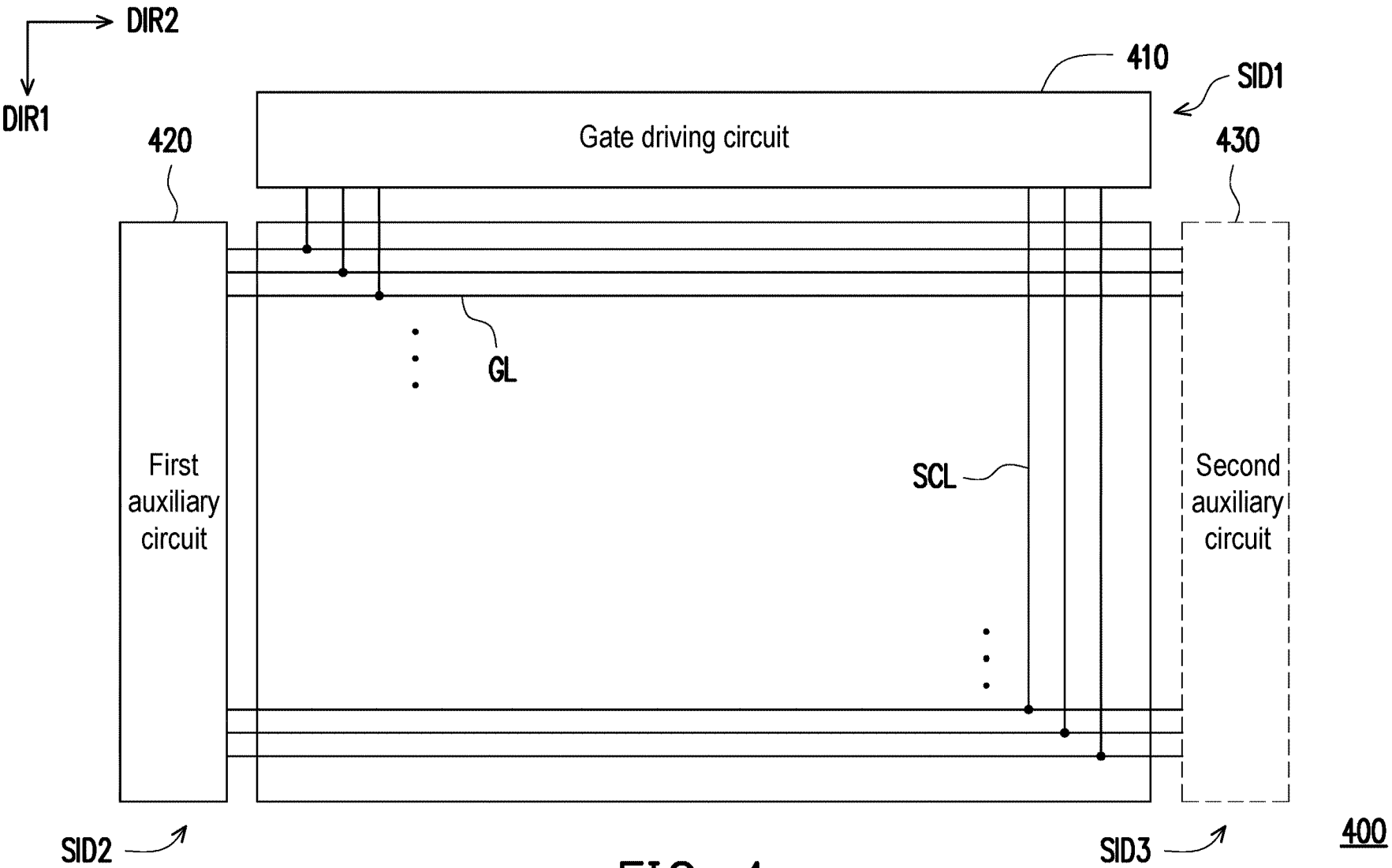
FIG. 4 is a schematic diagram of a display panel according to an embodiment of the disclosure.

Please refer to FIG. 4. FIG. 4 is a schematic diagram of a display panel according to an embodiment of the disclosure. In FIG. 4, the display panel 400 includes a gate driving circuit 410, a first auxiliary circuit 420, a plurality of scan lines GL, a plurality of gate signal lines SCL shown in solid lines, and a second auxiliary circuit 430 shown in dashed lines. In other embodiments, one or both of the first auxiliary circuit 420 and the second auxiliary circuit 430 may be disposed. The elements constituting the first auxiliary circuit 420 and the second auxiliary circuit 430 may be the same or different.

In this embodiment, the plurality of scan lines GL are arranged on the display panel 400 along a first direction DIR1. The gate driving circuit 410 is arranged on a first side SID1 of the display panel 400 (for example, a sky side of the display panel 400) along a second direction DIR2 that intersects the first direction DIR1. The first auxiliary circuit 420 and/or the second auxiliary circuit 430 are respectively arranged on a second side SID2 of the display panel 400 (for example, three sides other than the sky side of the display panel 400) and/or a third side SID3 opposite to the second side SID2 along the first direction DIR1, and are respectively coupled to the plurality of scan lines GL. In this embodiment, the first direction DIR1 is perpendicular to the second direction DIR2, but the disclosure is not limited thereto. The gate driving circuit 410 may be composed of the bias generator and the signal output circuit of the foregoing embodiments, and is coupled to the plurality of scan lines GL through the plurality of gate signal lines SCL. The gate driving circuit 410 may generate and provide a plurality of gate driving signals to the scan lines GL to drive the corresponding pixels on the display panel 400 for display through the scan lines GL. The first auxiliary circuit 420 and/or the second auxiliary circuit 430 may compensate for the plurality of gate driving signals generated by the gate driving circuit 410 through the scan lines GL.

Please note that, in this embodiment of the disclosure, the gate driving circuit 410 is arranged on the sky side of the display panel 400, and the first auxiliary circuit 420 and/or the third auxiliary circuit 430 are arranged on both sides close to the sky side. In this way, the border area on the sky side of the display panel 400 can be greatly reduced to meet the requirements of zero border display, and the charging and discharging capabilities of the gate driving circuit 410 can also be improved. For example, assuming that the size of the display panel 400 is 65 inches, and one data line and one gate line (1D1G) driving is used, when the resolution is 4K2K (that is, 3840*2160 pixels), the border area on the sky side of the display panel 400 of the disclosure can be reduced by about 61%; and when the resolution is 8K4K (that is, 7680*4320 pixels), the border area on the sky side of the display panel 400 of the disclosure can be reduced by about 81%.

Please refer to FIG. 5A to FIG. 5D for the implementation of the first auxiliary circuit 420 and/or the second auxiliary circuit 430 in the example of FIG. 4. FIG. 5A to FIG. 5D are schematic diagrams of auxiliary circuits according to different embodiments of the disclosure. Please note that, according to the design requirements, the first auxiliary circuit 420 and/or the second auxiliary circuit 430 may respectively include one or more or any combination of the auxiliary circuits 521 to 524 in FIG. 5A to FIG. 5D, to compensate for the gate driving signal generated by the gate driving circuit 410, but the disclosure is not limited thereto.

Figure 5A:
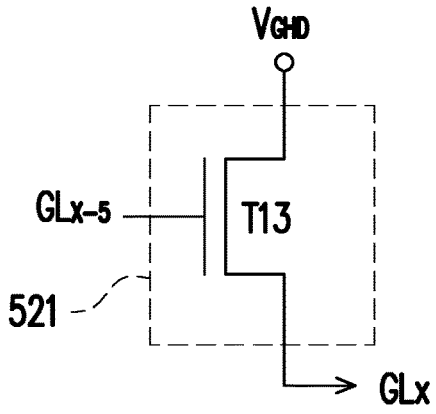
FIG. 5A to FIG. 5D are schematic diagrams of auxiliary circuits according to different embodiments of the disclosure.
Figure 5B:
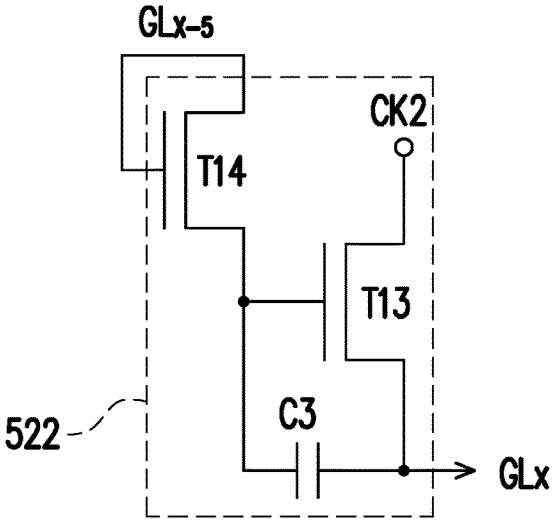

In FIG. 5A and FIG. 5B, the auxiliary circuits 521 and 522 are configured to provide a precharge path before the gate driving signal $GL_X$ charges the scan line, so that the speed of pulling up the gate driving signal $GL_X$ to a high potential (the first voltage $V_{GHD}$ in the example of FIG. 5A, and the second clock signal CK2 in the example of FIG. 5B, but the disclosure is not limited thereto) can be increased. In other words, the auxiliary circuits 521 and 522 may be pull-up circuits, and according to the design requirements, it is possible to select whether to pull up the gate driving signal $GL_X$ based on the voltage or the clock signal, without being restricted by both voltage and clock signal settings.

In detail, in FIG. 5A, the auxiliary circuit 521 is composed of a transistor T13. The first terminal of the transistor T13 receives the first voltage $V_{GHD}$, the second terminal of the transistor T13 receives the gate driving signal $GL_X$, and the control terminal of the transistor T13 receives the fore-stage gate driving signal (for example, the fore-five stage gate driving signal $GL_{X-5}$ in this embodiment, but the disclosure is not limited thereto), so that the auxiliary circuit 521 can pull up the gate driving signal $GL_X$ according to the fore-stage gate driving signal $GL_{X-5}$ based on the first voltage $V_{GHD}$. In FIG. 5B, the auxiliary circuit 522 includes transistors T13 and T14, and a capacitor C3. The first terminal of the transistor T13 receives the second clock signal CK2, and the second terminal of the transistor T13 receives the gate driving signal $GL_X$. The transistor T14 may be coupled as a diode configuration, and the anode of the diode configured receives the fore-stage gate driving signal (for example, the fore-five stage gate driving signal $GL_{X-5}$ in this embodiment, but the disclosure is not limited thereto) and the cathode of the diode configured is coupled to the control terminal of the transistor T13. The capacitor C3 may be coupled between the control terminal and the second terminal of the transistor T13, so that the auxiliary circuit 522 can pull up the gate driving signal $GL_X$ according to the fore-stage gate driving signal $GL_{X-5}$ based on the second clock signal CK2.

Figure 5C:
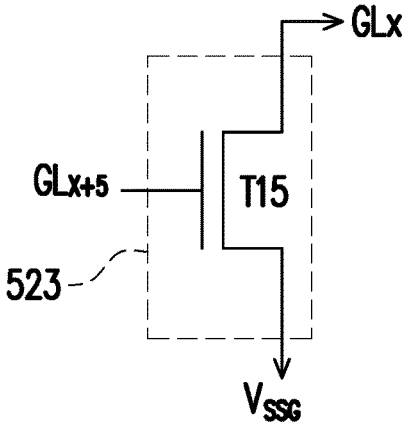

In FIG. 5C, the auxiliary circuit 523 is configured to provide an additional discharge path when the gate driving signal $GL_X$ discharges the scan line, so that the speed of pulling down the gate driving signal $GL_X$ to a low potential (the third voltage $V_{SSG}$ in this embodiment, but the disclosure is not limited thereto) can be increased. In this embodiment, the auxiliary circuit 523 is composed of a transistor T15. The first terminal of the transistor T15 receives the gate driving signal $GL_X$, the second terminal of the transistor T15 receives the third voltage $V_{SSG}$, and the control terminal of the transistor T15 receives the post-stage gate driving signal (for example, the post-five stage gate driving signal $GL_{X+5}$ in this embodiment, but the disclosure is not limited thereto). In other words, the auxiliary circuit 523 may be a pull-down circuit, and may pull down the gate driving signal $GL_X$ according to the post-stage gate driving signal $GL_{X+5}$ based on the third voltage $V_{GHD}$.

Figure 5D:
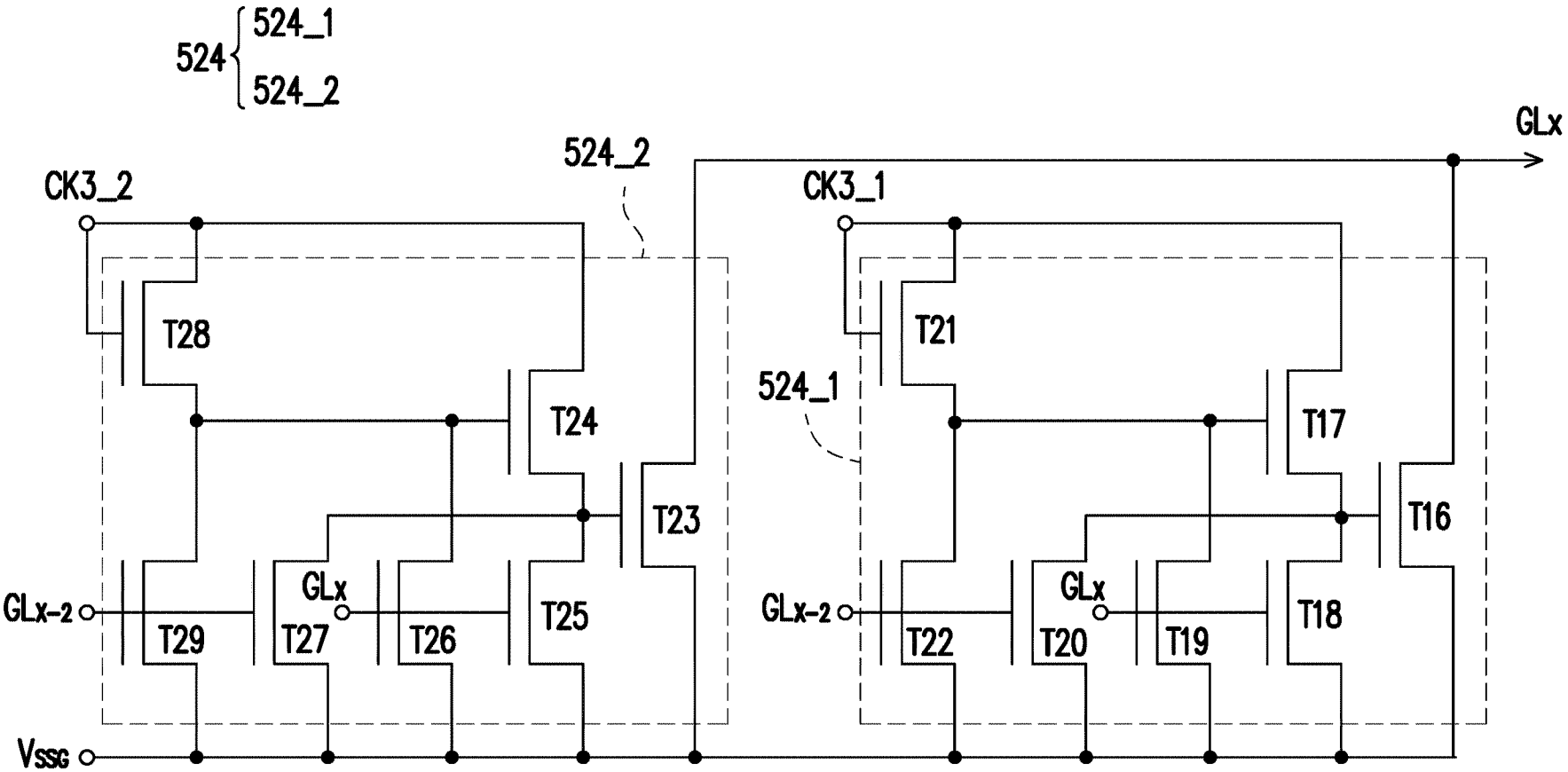

In FIG. 5D, the auxiliary circuit 524 is configured to provide a voltage stabilizing path when the gate driving signal $GL_X$ discharges the scan line, so as to prevent fluctuation generated due to the influence of crosstalk and thereby increase the speed of pulling down the gate driving signal $GL_X$ to a low potential (the third voltage $V_{SSG}$ in this embodiment, but the disclosure is not limited thereto). In this embodiment, the auxiliary circuit 524 is composed of multi-stage voltage controllers 524_1 and 524_2. The voltage controllers 524_1 and 524_2 respectively include transistors T16 to T22 and T17 to T29. Take the voltage controller 524_1 as an example, the first terminal of the transistor T16 receives the gate driving signal $GL_X$. The second terminal of the transistor T17 is coupled to the control terminal of the transistor T16. The first terminals of the transistors T18 and T20 are jointly coupled to the second terminal of the transistor T17. The first terminals of the transistors T19 and T22 are jointly coupled to the control terminal of the transistor T17. The transistor T21 may be coupled as a diode configuration, and the anode of the diode configured and the first terminal of the transistor T17 jointly receive the third clock signal CK3_1, and the cathode of the diode configured is coupled to the control terminal of the transistor T17. The control terminals of the transistors T18 and T19 jointly receive the gate driving signal $GL_X$. The control terminals of the transistors T20 and T22 jointly receive the fore-stage gate driving signal (for example, the fore-two stage gate driving signal $GL_{X-2}$ in this embodiment, but the disclosure is not limited thereto). The second terminals of the transistors T16, T18 to T20, and T22 jointly receive the third voltage $V_{SSG}$, so that the voltage controller 524_1 can compensate for the gate driving signal $GL_X$ according to the fore-stage gate driving signal $GL_{X-2}$ and the gate driving signal $GL_X$ based on the third voltage $V_{SSG}$. The elements in the voltage controller 542_2 are coupled in the same manner, which is not repeated hereinafter.

Please note that, according to the design requirements, the disclosure may use combinations of different auxiliary circuits 521 to 524 in the above embodiments of FIG. 5A to FIG. 5D to form the first auxiliary circuit 420 and/or the second auxiliary circuit 430 shown in FIG. 4. The auxiliary circuits 521 and 522 can provide the auxiliary function of precharge on the scan line according to the fore-stage gate driving signal $GL_{X-5}$, so that the speed of pulling up the gate driving signal $GL_X$ to a high potential can be increased. The auxiliary circuit 523 can provide the auxiliary function of rapid discharge on the scan line according to the post-stage gate driving signal $GL_{X+5}$, so that the speed of pulling down the gate driving signal $GL_X$ to a low potential can be increased. The auxiliary circuit 524 can stabilize the gate driving signal $GL_X$ according to the fore-stage gate driving signal $GL_{X-5}$, the gate driving signal $GL_X$, and the start signal ST, so that the speed of pulling down the gate driving signal $GL_X$ to a low potential can be increased. In this way, the first auxiliary circuit 420 and/or the second auxiliary circuit 430 can compensate for the gate driving signal $GL_X$ according to the design requirements, thereby improving the charging and discharging capabilities of the gate driving circuit.

Figure 6:
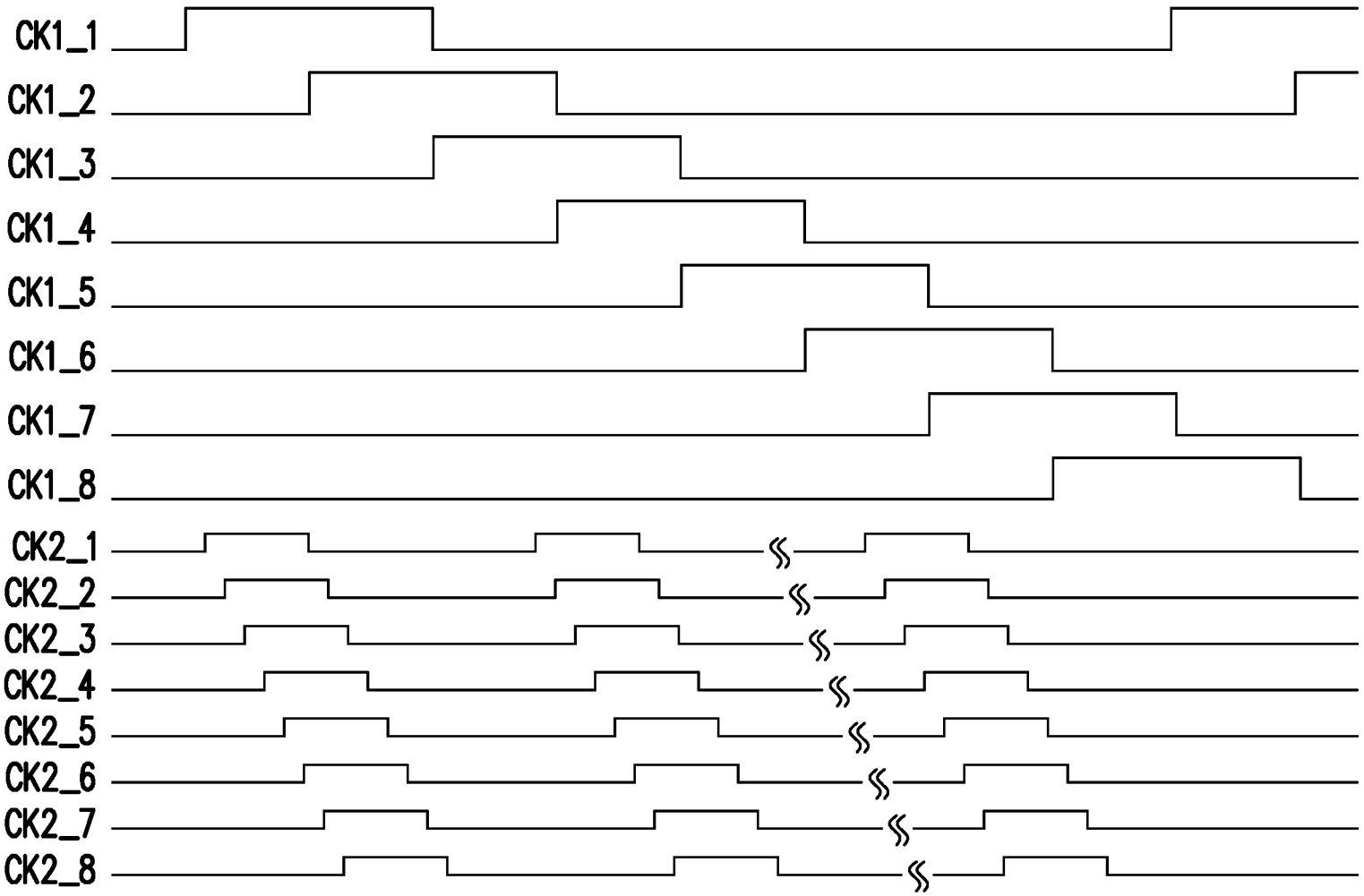
FIG. 6 is a timing diagram of clock signals according to an embodiment of the disclosure.

Please refer to FIG. 1 and FIG. 6. FIG. 6 is a timing diagram of clock signals according to an embodiment of the disclosure. The gate driving circuit 110 can sequentially drive the bias generators 111_1 and 111_2 and the corresponding signal output circuits 112_1 to 112_P by timing control to control the charging and discharging times of the gate driving signals GL_1 to GL_P for the scan lines. For example, the first clock signals CK1_1 to CK1_8 in FIG. 6 can be used to sequentially drive eight bias generators, and the second clock signals CK2_1 to CK2_8 can be used to sequentially drive eight signal output circuits. Take the gate driving circuit 110 in FIG. 1 as an example, the bias generators 111_1 and 111_2 may respectively receive the first clock signals CK1_1 and CK1_2 to be sequentially driven. The signal output circuits 112_1 to 112_8 (R=8 in this example) in the group GP_1 corresponding to the bias generator 111_1 may respectively receive the second clock signals CK2_1 to CK2_8 to be sequentially driven. Therefore, after the first clock signal CK1_1 is pulled up, that is, the bias generator 111_1 is driven, the signal output circuits 112_1 to 112_8 may be sequentially driven according to the second clock signals CK2_1 to CK2_8. In this embodiment, there is a predetermined phase difference between adjacent two of the first clock signals CK1_1 to CK1_8, and after the first clock signal CK1_1 is pulled up, the second clock signals CK2_1 to CK2_8 may be sequentially pulled up. Nevertheless, the number of the clock signals described above is only an example for illustration and is not intended to limit the disclosure.

Figure 7:
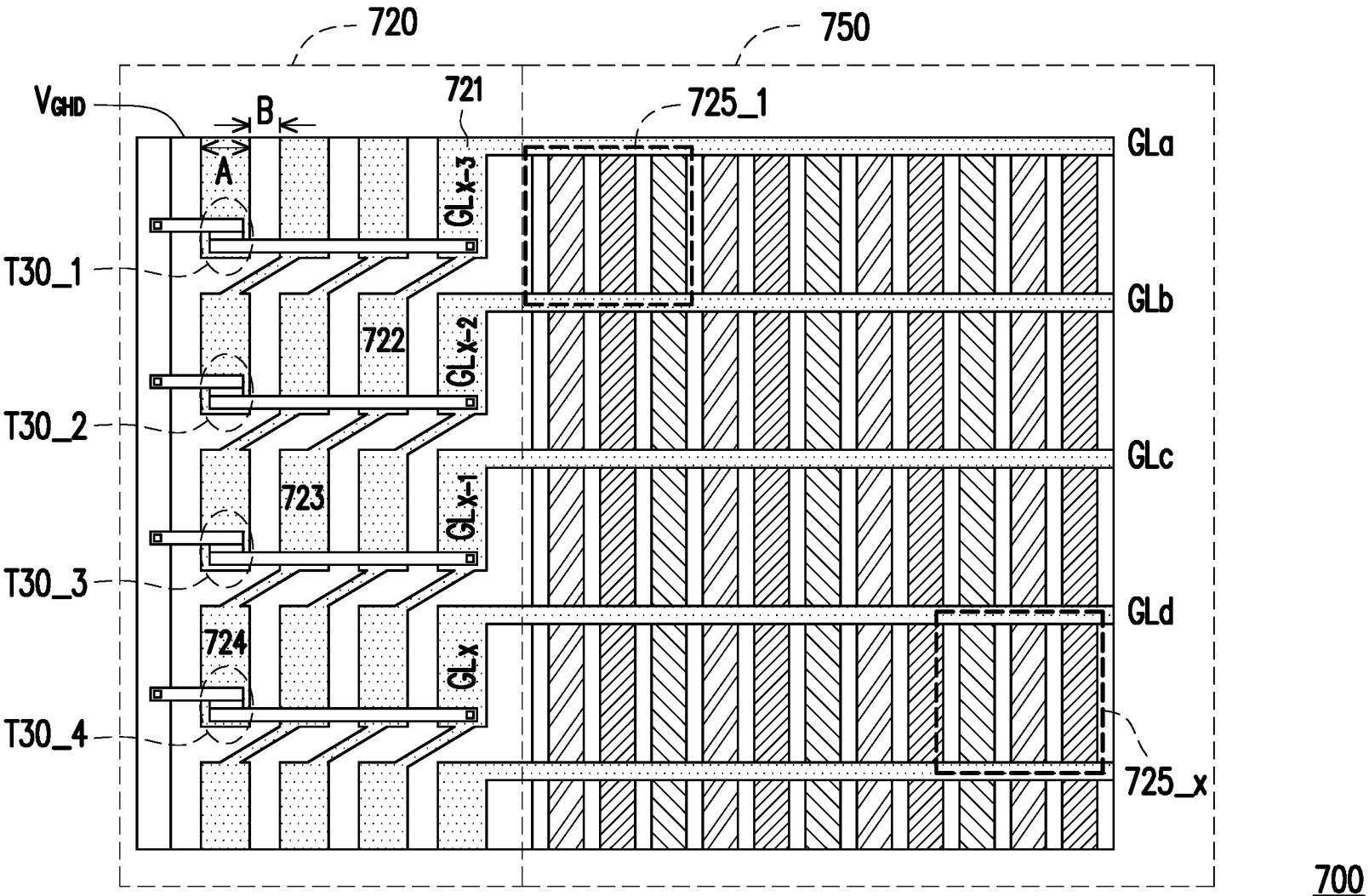
FIG. 7 is a schematic diagram of a partial structure of a display panel according to an embodiment of the disclosure.

Please refer to FIG. 7. FIG. 7 is a schematic diagram of a partial structure of a display panel according to an embodiment of the disclosure. In FIG. 7, the display panel 700 includes a first auxiliary circuit 720 and a display region 750. The display region 750 at least includes a pixel array composed of pixels 725_1 and 725_*x* and scan lines GLa to GLd. The scan lines GLa to GLd respectively provide gate driving signals $GL_{X-3}$ to $GL_X$. The pixels 725_1 and 725_*x* may respectively drive pixels with different wavelengths (for example, red, green, and blue (RGB)) for display according to the gate driving signals $GL_{X-3}$ and $GL_X$ provided on the scan lines GLa and GLd. The first auxiliary circuit 720 is arranged on a side of the display region 750. The first auxiliary circuit 720 at least includes one power rail, transistors T30_1 to T30_4, and conductive paths 721 to 724. In this embodiment, the power rail is used to transmit the first voltage $V_{GHD}$. In other embodiments, the power rail may also be used to transmit clock signals or other voltages.

In this embodiment, the first terminals of the transistors T30_1 to T30_4 are jointly coupled to the power rail to receive the first voltage $V_{GHD}$, and the second terminals of the transistors T30_1 to T30_4 are respectively coupled to the scan lines GLa to GLd to compensate for the gate driving signals $GL_{X-3}$ to $GL_X$. The control terminals (gates) of the transistors T30_1 to T30_4 may receive the fore-stage or post-stage gate driving signal. For example, the control terminal of the transistor T30_4 may receive the gate driving signal $GL_{X-3}$ as the fore-stage gate driving signal according to the conductive paths 721 to 724, to pull up the gate driving signal $GL_X$ based on the first voltage $V_{GHD}$ and the fore-stage gate driving signal $GL_{X-3}$. Therefore, according to the design requirements, the circuit structure of the first auxiliary circuit 720 can be designed to compensate for the gate driving signal $GL_X$ (N>0) according to the fore-N stage or post-N stage gate driving signal based on other voltages or clock signals. For example, in this embodiment, the width of the line width A may be 8 μm and the width of the line spacing B may be 10 μm, and if the border on one single side of the display panel is limited to 900 μm, the transistors T30_1 to T30_4 can receive at most the fore-50 stage or post-50 stage gate driving signals (N=50).

In the above embodiments, the transistors T1 to T29 and T30_1 to T30_4 may be, for example, thin film transistors (TFT). The first voltage $V_{GHD}$ may be a direct current gate high potential, and the second voltage $V_{SSQ}$ and the third voltage $V_{SSG}$ may be a ground potential.

In summary, in the display panel according to the disclosure, the gate driving circuit is arranged on the side of the display panel along another direction intersecting the direction in which the scan lines are arranged, and the gate driving signals are generated and provided to the scan lines through a plurality of bias generators and a plurality of corresponding signal output circuits. In this way, the border area of the display panel can be greatly reduced, and the charging and discharging capabilities of the gate driving circuit can also be improved.

Although the disclosure has been disclosed as the above embodiments, they are not intended to limit the disclosure. Any person with ordinary knowledge in the field can make changes and modifications without departing from the spirit and scope of the disclosure. Therefore, the scope of the disclosure is defined by the appended claims.

What is claimed is:

1. A display panel, comprising:

a plurality of scan lines arranged on the display panel along a first direction, and respectively providing a plurality of gate driving signals; and a gate driving circuit arranged on a first side of the display panel along a second direction that intersects the first direction, the gate driving circuit comprising a plurality of bias generators and a plurality of signal output circuits, wherein the plurality of signal output circuits are divided into a plurality of groups, the bias generators respectively correspond to the plurality of groups, the plurality of bias generators generate a plurality of first bias voltages, and the plurality of groups generate the plurality of gate driving signals respectively according to the plurality of first bias voltages, wherein each of the plurality of bias generators comprises:

a first pull-up circuit pulling up a first control voltage according to a fore-stage bias voltage based on a first voltage;

a second pull-up circuit pulling up a second control voltage according to a first clock signal;

a first pull-down circuit pulling down the first control voltage according to a start signal, the second control voltage and/or a post-stage bias voltage;

a second pull-down circuit pulling down the second control voltage according to the start signal and/or the first control voltage; and an output stage circuit generating each of the plurality of first bias voltages corresponding to the plurality of groups according to the first control voltage and the second control voltage.

2. The display panel according to claim 1, wherein the first pull-up circuit is a pull-up transistor, wherein a first terminal of the pull-up transistor receives the first voltage, and a control terminal of the pull-up transistor receives the fore-stage bias voltage for pulling up the first control voltage on a second terminal of the pull-up transistor;

the second pull-up circuit is a pull-up capacitor, wherein a first terminal of the pull-up capacitor receives the first clock signal for pulling up the second control voltage on a second terminal of the pull-up capacitor;

the first pull-down circuit comprises a plurality of first pull-down transistors, wherein first terminals of the plurality of first pull-down transistors receive the first control voltage, second terminals of the plurality of first pull-down transistors receive a second voltage, and control terminals of the plurality of first pull-down transistors respectively receive the start signal, the second control voltage, and the post-stage bias voltage to pull down the first control voltage;

the second pull-down circuit comprises a plurality of second pull-down transistors, wherein first terminals of the plurality of second pull-down transistors receive the second control voltage, second terminals of the plurality of second pull-down transistors receive the second voltage, and control terminals of the plurality of second pull-down transistors respectively receive the start signal and the first control voltage to pull down the second control voltage; and the output stage circuit is a buffer, wherein the buffer receives the first clock signal and a third voltage to generate each of the plurality of first bias voltages corresponding to the plurality of groups according to the first control voltage and the second control voltage.

3. The display panel according to claim 1, wherein each of the plurality of bias generators further provides the second control voltage as a second bias voltage, wherein each of the plurality of signal output circuits in a same group comprises:

a plurality of buffers respectively receiving a plurality of second clock signals, wherein the plurality of buffers respectively generates corresponding gate driving signals according to a first bias voltage and the second bias voltage.

4. The display panel according to claim 1, wherein each of the plurality of signal output circuits in a same group comprises:

a plurality of buffers respectively receiving a plurality of second clock signals, wherein the plurality of buffers respectively generate corresponding gate driving signals only according to the first bias voltage, and maintain voltage values of the plurality of gate driving signals according to the corresponding gate driving signals and the first bias voltage.

5. The display panel according to claim 1, wherein each of the plurality of signal output circuits in a same group comprises:

multi-stage voltage generators respectively generating corresponding gate driving signals, wherein each of the multi-stage voltage generators comprises:

a first transistor, wherein a first terminal of the first transistor receives a second clock signal, and a control terminal of the first transistor receives the first bias voltage;

a second transistor, wherein a first terminal of the second transistor is coupled to a second terminal of the first transistor, and a second terminal of the second transistor receives the first bias voltage;

a third transistor and a fourth transistor, wherein first terminals of the third transistor and the fourth transistor are both coupled to a control terminal of the second transistor, second terminals of the third transistor and the fourth transistor both receive a second voltage, a control terminal of the third transistor receives the first bias voltage, and a control terminal of the fourth transistor receives the start signal; and a capacitor coupled between the first terminal of the first transistor and the control terminal of the second transistor.

6. The display panel according to claim 1, further comprising:

a first auxiliary circuit arranged on a second side of the display panel along the first direction, wherein the first auxiliary circuit is coupled to the plurality of scan lines for compensating for the plurality of gates driving signals generated by the plurality of signal output circuits.

7. The display panel according to claim 6, wherein the first auxiliary circuit comprises:

a plurality of first transistors pulling up the plurality of gate driving signals according to a plurality of fore-stage gate driving signals based on a first voltage or a first clock signal.

8. The display panel according to claim 7, wherein the first auxiliary circuit further comprises:

a plurality of second transistors respectively coupled as a plurality of diodes, wherein the plurality of diodes respectively have a plurality of cathodes respectively coupled to control terminals of the plurality of first transistors, and a plurality of anodes of the plurality of diodes respectively receive the plurality of fore-stage gate driving signals; and a plurality of capacitors respectively coupled between the control terminals and second terminals of the plurality of first transistors.

9. The display panel according to claim 6, wherein the first auxiliary circuit comprises:

a plurality of first transistors pulling down the plurality of gate driving signals according to a plurality of post-stage gate driving signals based on a first voltage.

10. The display panel according to claim 6, wherein the first auxiliary circuit comprises:

multi-stage voltage controllers compensating for the plurality of gate driving signals according to a fore-stage gate driving signal based on a plurality of first clock signals, wherein each of the multi-stage voltage controllers comprises:

a first transistor, wherein a first terminal of the first transistor receives each corresponding gate driving signal;

a second transistor, wherein a second terminal of the second transistor is coupled to a control terminal of the first transistor;

a third transistor and a fourth transistor, wherein first terminals of the third transistor and the fourth transistor are both coupled to the second terminal of the second transistor;

a fifth transistor and a sixth transistor, wherein first terminals of the fifth transistor and the sixth transistor are both coupled to a control terminal of the second transistor;

a seventh transistor coupled as a diode configuration, and having a cathode coupled to the control terminal of the second transistor and having an anode, wherein the anode and a first terminal of the second transistor jointly receive each corresponding first clock signal, wherein control terminals of the third transistor and the fifth transistor both receive corresponding gate driving signals, control terminals of the fourth transistor and the sixth transistor both receive the fore-stage gate driving signal, and second terminals of the first transistor, the third transistor, the fourth transistor, the fifth transistor, and the sixth transistor all receive a first voltage.

11. The display panel according to claim 6, further comprising:

a plurality of second auxiliary circuits arranged on a third side opposite to the second side of the display panel along the first direction, wherein the plurality of second auxiliary circuits are coupled to the plurality of scan lines for compensating for the plurality of gate driving signals generated by the plurality of signal output circuits.

* * * * *